United States Patent [19]

Heijenga

[11] Patent Number: 4,863,036

[45] Date of Patent: Sep. 5, 1989

[54] CONTAINER FOR A SMALL QUANTITY OF MILK, CREAM OR THE LIKE

[75] Inventor: Berend Heijenga, Almelo, Netherlands

[73] Assignee: H S M, Almelco, Netherlands

[21] Appl. No.: 216,363

[22] Filed: Jul. 7, 1988

[30] Foreign Application Priority Data

Jul. 17, 1987 [NL] Netherlands ..... 8701701

[51] Int. Cl.[4] ..... B65D 5/72; B65D 85/80

[52] U.S. Cl. ..... 206/629; 206/630; 206/633; 206/525

[58] Field of Search ..... 206/629, 525, 633, 628, 206/630

[56] References Cited

U.S. PATENT DOCUMENTS 3,650,390 3/1972 Chung ..... 206/525 X
3,660,960 5/1972 Inman .

FOREIGN PATENT DOCUMENTS 2155069 5/1973 Fed. Rep. of Germany .
3446093A1 6/1986 Fed. Rep. of Germany .
1210375 5/1960 France .
2198461 3/1974 France .

*Primary Examiner*—Arnold Rosenthal
*Attorney, Agent, or Firm*—Larson and Taylor

[57] ABSTRACT

A container for a small quantity of milk, cream or the like, comprising a tub-shaped filling cavity (1) with a flat circumferential stiff rim (4) and a cover sheet (5) thereto by means of a sealing seam, said flat rim and cover sheet at one side being extended beyond the connecting seam (6), for forming a pulling tab (5') allowing said sheet to be pulled away for forming a dispensing opening. In the extended rim portion (4') of the stiff rim (4) a channel (7) communicating with the filling cavity (1) is formed, extending slightly beyond the connecting seam (6) and transversely to the outer boundary (8) of said seam (6), said channel (7), beyond the connecting seam (6), being surrounded by an additional sealing seam (9) which is weaker than the connecting seam portion (6') extending transversely to said channel (7), so that said pulling tab (5') can be pulled away up to said connecting seam (6'), for uncovering a dispensing opening (7') with a fixed small dimension of said channel (7).

6 Claims, 1 Drawing Sheet

CONTAINER FOR A SMALL QUANTITY OF MILK, CREAM OR THE LIKE

Figure 1:
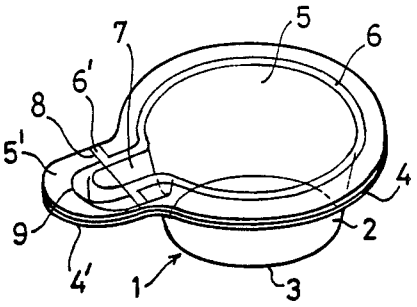

For making available to users small quantities of milk or cream, in particular intended for one single cup of coffee or the like, containers are known comprising a tub-shaped filling cavity defined by a wall of rigid-elastic foil material terminated by a circumferential plane rim of the same foil material, said filling space being covered by a cover sheet consisting of a, particularly less rigid, foil material which is connected to said flat rim by means of a sealing connection seam, said plane rim and said cover sheet being extended at one side beyond said connecting seam, the extended portion of said cover sheet forming, there, a pulling tab so as to allow to form an opening after pulling away the cover sheet, through which the contents present in the filling space can be dispensed.

When pulling away the cover sheet the connecting seam formed by means of a welding or glueing operation or the like will at least partly be disrupted, a dispensing opening thus being uncovered above the tub-like filling cavity.

Such containers have practical draw-backs. For inducing, the disruption of the connecting seam a relatively large force is required, and the required tearing force is reduced after the seam has been broken in one point, which, on the one hand, will often lead to pulling the cover sheet away too far and, thus, forming a too large opening, and, on the other hand, to a certain shock movement causing the contents splashing outwards through to the too wide opening. When using such containers in aeroplanes in which a lower air pressure is present than the normal air pressure present when filling said containers, the air cushion which is inevitably present in a container will, when forming an opening, expand so that the contents will splash outwards. If, furthermore, only a portion of the contents will be used, it is unavoidable that, in the case of a toppling container, its contents will flow outwards through the relatively large opening, which will lead to soiling.

It is an object of the invention to improve such a container for these and similar purposes, and to provide a container being characterised in that, in the extended portion of the rim, a channel communicating with the filling cavity is formed, said channel extending outwards slightly beyond the connecting seam and transversely to the latter's outer boundary, and in that said channel, beyond said connecting seam, is surrounded by an additional sealing seam between said rim and the pulling tab portion of the cover sheet, said additional sealing seam being weaker than the connecting seam portion extending transversely to said channel, this in such a manner, that said pulling tab can be pulled away up to said connecting seam, then uncovering a fixed dispensing opening for said channel.

This additional sealing seam provides an air-tight and sterile closure of the channel, and can be disrupted with relatively little force until the connecting seam extending transversely to the channel has been reached, the latter seam being sufficiently strong for preventing that the tab is pulled further by the exerted force. The outer boundary of the connecting seam then forms, together with the boundary edge of said channel, a dispensing opening with a fixed and small size, the latter being such that the contents, because of its surface tension and viscosity and the created negative pressure, will not flow outwards by itself, but can be driven outwards jetand even drop-wise by pressing inwards the container wall, which has not only the advantage that, when a partly filled container topples, the contents thereof will not or not appreciably flow outward, but also that an accurately metered dispensing of the contents becomes possible. In the case of an overpressure within the container, and when forming the dispensing opening, at most a small quantity of the contents being present in the channel will be driven outwards, whereafter the air within the container can expand.

In particular the terminal wall of the channel ends substantially perpendicularly to the plane of the stiff rim, thus avoiding that, there, liquid, and in the case of milk or cream in particular separated milk fat drops, will stay behind by cohesion forces, which might obstruct the opening thus formed or might be forcibly driven outwards by the pressure equalisation.

In particular the channel has a pointed shape in the plane of the stiff rim, the additional sealing seam surrounding this pointed portion, which facilitates its loosening, and, moreover, also a drop-wise dispensing of the contents will be facilitated thereby.

In a special embodiment the channel has the shape of a spout extending from the lateral wall of the filling cavity and having a decreasing height in the direction of the dispensing opening. An advantage thereof is that the contents, in the closed condition, can flow off easier from the spout, and that, when opening, the air cushion can immediately expand without driving outwards drops of the contents.

Moreover the broadened rim portion can be provided, beyond the additional sealing seam, with a line of rupture, the rim beyond said line of rupture being connected with the cover sheet in such a manner that, when disrupting said line of rupture, a stiffened pulling tab for the cover sheet is obtained which facilitates the gripping thereof.

In order to unambiguously avoid that the cover sheet is pulled away beyond the connecting seam, said connecting seam is preferably provided transversely to the channel over the full width of the extended rim portion, the outer boundary thereof extending substantially along a straight line directed transversely to the axis of the channel, said line restricting the loosening of the cover sheet over the full width, and said cover sheet can, if desired, be torn off along said line, so that dispensing the contents will not be obstructed thereby.

Figure 2:
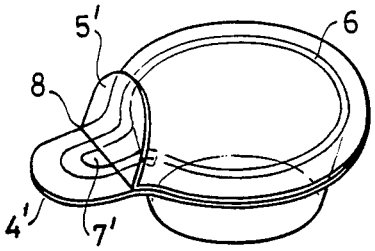
Figure 3:
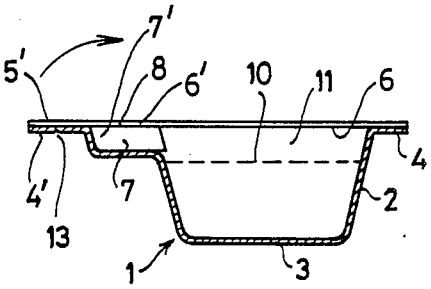
Figure 4:
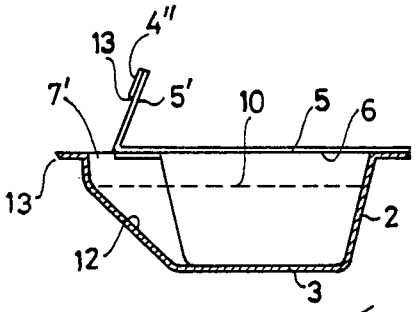
Figure 5:
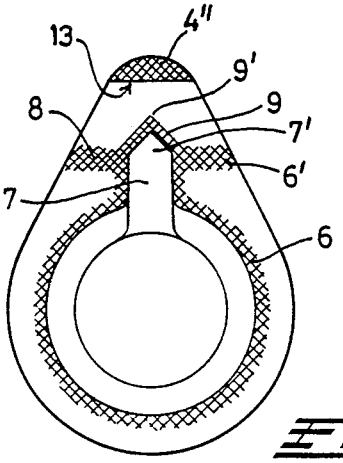

The invention will be elucidated below in more detail by reference to a drawing, showing in:

FIGS. 1 and 2 representations in perspective of an embodiment of the container according to the invention in the closed and opened conditions resp., the walls thereof being shown as being transparent;

FIG. 3 is a cross-section of the closed container of FIG. 1;

FIG. 4 a cross-section of another embodiment of the container of the invention in the opened condition; and FIG. 5 a top view of such a container with a special embodiment of the terminal portion of the dispensing channel.

The container according to the invention, which, in particular, is intended for a small quantity of milk, cream or the like, corresponds, as far as its shape is concerned, substantially with the known tub-shaped milk containers.

The embodiment shown in FIGS. 1, 2 and 3 comprises a cavity 1 to be filled with milk, cream or the like, and defined by a wall 2 and a flat bottom 3 made of a relatively rigid elastic plastics foil material joined by a flat circumferential rim 4 of the same material. At one side said rim 4 is provided with an extension 4'.

The cavity 1 is covered by a cover sheet 5, in particular made of a thinner foil material which is provided with an extension 5' as well, having the same shape as the portion 4' of the rim 4. This cover sheet 5 is fixed on the rim 4 by means of a circumferential connecting seam 6 shown in FIGS. 1 and 2 by an uninterrupted line. This connecting seam is of the current kind, and is, for instance, formed by means of a welding operation or the like. The foil material of the rim 4 and the sheet 5 is, for instance, thermoplastics, or consists of metal foil with a thermoplastics inner lining. It will be clear that any kind of foil material which is compatible with the intended contents and which can be sealed in a suitable manner is suitable for the present purpose.

In the rim 4 and its extension 4' a relatively shallow channel 7 is formed which, at one end, communicates with the cavity 1, and, at the other end, terminates at 7' beyond the extremity of the connecting seam 6. In particular the connecting seam 6 is, as shown at 6' in FIGS. 1 and 2, widened in such a manner that it extends over the full width of the extended rim portion 4', its outer boundary 8 extending substantially rectilinearly and transversely to the axis of the channel 7. Moreover an additional sealing seam 9 is provided around the terminal portion 7' between the extended rim portion 4' and the corresponding portion 5' of the cover sheet 5, by means of which this terminal portion 7' of the channel 7 is closed in a sealed manner.

The part of the cover sheet portion 5' situated outside the additional sealing seam 9 can be loose from the corresponding portion 4' of the rim 4, at least near its edge, so that it can be turned upwards and can be gripped as a pulling tab. If this pulling tab is pulled away, the sealing seam 9, which is relatively weak, can easily be disrupted, and the pulling tab can be pulled away in the manner shown in FIG. 2 until the boundary edge 8 of the stronger connecting seam 6 has been reached. The terminal portion 7' then forms a pouring or dispensing opening through which the contents can flow outwards from the filling cavity.

Since said opening 7' is relatively small, the contents will not flow outwards from the channel 7 by itself, but a given pressure is to be exerted on the wall 2 and/or the cover sheet 5 for driving outwards said contents. This can take place, depending on the exerted pressure, jet- or drop-wise. When the container topples, the contents will not or hardly flow outwards as a consequence of the surface tension, the viscosity and the negative pressure.

As indicated in FIG. 3 by an interrupted line 10, the cavity 1 will only partly be filled with milk, cream or the like. On top thereof an air cushion 11 is present. The channel 7 has a relatively small cross-section, so that, if during transport a portion of the contents will arrive in the channel 7, the quantity thereof will be small, and, depending on viscosity and surface tension of the contents, the penetration of the liquid therein will be prevented as given small dimensions of this channel. If the pressure of the air cushion 11 is higher than the ambient pressure, as, for instance, will be the case in aeroplanes, the air can quickly expand when opening the container, and only a very small quantity of the liquid in the channel will be driven outwards. By terminating the terminal portion 7' of the channel 7, as appears from FIG. 3, substantially perpendicularly to the plane of the rim 4', it will be avoided that, there, under the influence of the surface tension liquid drops or separated milk fat drops will adhere. For these drops might bring about a certain obstruction of the formed opening, which would impede dispensing the contents, or these drops would be generally driven outwards when releaving the overpressure.

In a modified embodiment according to FIG. 4 the channel 7 is widened to form a spout 12 converging from the laterial wall 2 upwards towards the rim 4 and the rim portion 4'. The outflow will, then, be exclusively restricted by the formed opening 7', and the liquid contents can flow easier through this spout than in the case of the shallow channel 7. Moreover FIG. 4 shows another modification, which can also be applied in the embodiment of FIGS. 1..3. Therein, in the rim portion 4' and beyond the opening 7', a line of rupture 13 is formed which is also indicated in FIG. 3, and which allows, before pulling away the cover sheet 5, to break off the rim portion 4' beyond the additional sealing seam 9, the portion 4'' between said line of rupture and the outer rim then being attached to the sheet portion 5', so that, after rupturing, a stiffened pulling tab is obtained as clearly follows from FIG. 4.

Moreover it will be clear that the pulling tab portion 5' of the cover sheet 5 can be pulled off along the boundary line 8 after being pulled away, so that it will not form an obstacle when dispensing the contents, and, if required, the cover sheet can be provided with a line of weakness for that purpose.

FIG. 5 shows a special embodiment of the channel portion 7' or the corresponding part of the spout 12, and of the additional sealing seam 9 surrounding said terminal portion. Therein the terminal portion 7' has been given a pointed shape, and also the seam 9 terminates in a pointed end 9'. This facilitates pulling away the pulling tab portion of the cover sheet 5. Since the seam 9 is weak in the point 9', it is advisable to protect said point in the manner shown in FIG. 4 by means of an attachment at 4'' and an adjacent line of rupture 13.

It will be clear that within the scope of the invention many modifications are possible. If required by the character of the contents of such a container, a tube section with a suitable small bore can be sealed, if required, in the channel 9, said tube ensuring that the channel can not be pinched, and the bore thereof can be adapted to the viscosity and the surface tension of the contents.

What is claimed:

1. A container for a small quantity of milk, cream or the like, with a tub-shaped filling cavity having a wall made of a rigid-elastic foil material joined by a flat circumferential stiff rim made of the same foil material, and a cover sheet made of a particularly less rigid foil material, said sheet being connected, by means of a sealing connecting seam, circumferentially with said flat rim and covering the filling cavity, said flat rim and cover sheet at one side being extended beyond the connecting seam, the extended portion of said cover sheet forming a pulling tab by means of which said sheet can be pulled away for forming an opening through which the contents being present in the filling cavity can be dispensed, characterised in that, in the extended rim portion (4') of the stiff rim (4) a channel (7) communicating with the filling cavity (1) is formed, extending outwards slightly beyond the connecting seam (6) and transversely to the outer boundary (8) of said seam (6), and in that this channel, beyond the connecting seam (6), is surrounded by an additional sealing seam (9) between this rim portion (4') and the pulling tab (5') of the cover sheet (5), said additional sealing seam (9) being weaker than the connecting seam portion (6') extending transversely to said channel (7), this in such a manner that said pulling tab (5') can be pulled away up to said connecting seam (6'), thus uncovering a dispensing opening (7') with a fixed small dimension for said channel (7).

2. The container of claim 1, characterized in that the terminal wall of the channel (7) joins the plane of the flat rim (4) substantially perpendicularly.

3. The container of claim 1, characterised in that the channel (7) pointedly converges in the plane of the stiff rim (4, 4'), and in that the additional sealing seam (9) is provided with a corresponding pointed part (9').

4. The container of claim 1, characterised in that the channel (7) has the shape of a spout (12) extending from the lateral wall of the filling cavity and having a decreasing height towards the dispensing opening (7').

5. The container of claimi 1, characterised in that the extended rim portion (4') is provided, beyond the additional sealing seam (9), with a line of rupture (13), said line being connected with the pulling tab portion (5') of the cover sheet (5) for forming a stiffened pulling tab (4'') after rupturing said line of rupture (13).

6. The container of claim 1, characterised in that the connecting seam (6') extends transversely to the channel (7) over the full width of the extended rim portion (4'), its outer boundary (8) extending substantially along a straight line directed transversely to the channel axis.

* * * * *